United States Patent [19]

Takeichi et al.

[11] 4,052,724

[45] Oct. 4, 1977

[54] BRANCHING FILTER

[75] Inventors: Yoshihiro Takeichi; Tsutomu Hashimoto; Fumio Takeda, all of Kamakura; Takashi Katagi, Yamato, all of Japan

[73] Assignee: Mitsubishi Denki Kabushiki Kaisha, Tokyo, Japan

[21] Appl. No.: 723,654

[22] Filed: Sept. 15, 1976

Related U.S. Application Data

[63] Continuation-in-part of Ser. No. 534,840, Dec. 20, 1974, abandoned.

[51] Int. Cl.[2] ..... H01Q 13/02; H01P 5/12

[52] U.S. Cl. ..... 343/786; 333/6; 343/858

[58] Field of Search ..... 333/6, 9, 73 W; 343/773, 786, 854, 857, 858

[56] References Cited

U.S. PATENT DOCUMENTS

| | | | |
|---|---|---|---|
| 2,867,773 | 1/1959 | Korman | 333/9 X |
| 3,156,879 | 11/1964 | Hess | 333/6 |
| 3,566,309 | 2/1971 | Hjioka | 333/6 |
| 3,696,434 | 10/1972 | Sciambi, Jr. | 343/786 X |

*Primary Examiner*—Paul L. Gensler

*Attorney, Agent, or Firm*—Oblon, Fisher, Spivak, McClelland & Maier

[57] ABSTRACT

A branching filter for branching two microwaves from waves having two microwaves and a plurality of milliwaves includes two groups of coupling holes fluidically connected to one or more band-pass filters and a branching waveguide, one group of coupling holes being arranged on the wall of the conical horn so as to be equiangularly disposed thereabout with a 90° interval defined between adjacent coupling holes when, for example, four coupling holes, filters, and waveguides are employed in such group, while the second group of coupling holes, disposed axially downstream of the first group of holes by means of a predetermined distance, is similarly disposed about the horn although angularly offset with respect to the holes of the first group through means of an angle of 45°.

6 Claims, 3 Drawing Figures

BRANCHING FILTER

CROSS REFERENCE TO RELATED APPLICATIONS

This application is a continuation-in-part application of application Ser. No. 534,840, filed Dec. 20, 1974 now abandoned.

BACKGROUND OF THE INVENTION

1. Field of the Invention:

The present invention relates to wave guides and more particularly to an improved branching filter for branching a wave having one or more frequency bands from a wave having multi-frequency bands through coupling holes disposed on a conical horn.

2. Description of the Prior Art:

Heretofore, when it was desirable to branch a wave having a desirable frequency band from a conical horn propagating a wave having multifrequency bands through coupling holes disposed within the conical horn, to a branching waveguide, the coupling holes have been disposed on the same ridge line of the conical horn depending upon a desirable frequency band for branching.

Accordingly, in the case of desirable frequency bands for branching, having a small frequency differential therebetween the coupling holes have been disadvantageously overlapped.

In order to overcome such disadvantages, a desirable number of circular wave guides and tapered waveguides, corresponding to the number of frequency bands for branching, have been connected in series with coupling holes disposed on a wall of each of the circular waveguides.

However, there have been disadvantages such as the necessity for an axially elongated branching filter and the excitation or generation of higher order mode waves which cause electrical difficulties, and in addition, when the horn is used in conjunction with wide band zones, the circular waveguide connected to the horn becomes excessively large or oversized for high frequency waves.

SUMMARY OF THE INVENTION

It is therefore an object of the present invention to provide an improved branching filter for branching two microwaves from waves having two microwaves and one or more milliwaves through coupling holes disposed on a conical horn.

In the case of disposing two groups of branching filters (having the function for branching waves having particular frequencies from a multifrequency wave) upon the wall of a conical horn, the coupling holes of the first group associated with the filters are arranged with equal angular displacements therebetween, of, for example, 90° when four holes are provided, and coupling holes of the second group are similarly arranged but are angularly offset with respect to the holes of the first group through an angular displacement of 45°. In this manner, it is possible to attain the effect that a wave having close frequency bands can be branched and the excitation of a higher order mode wave is low. More particularly, when two microwaves, such as, for example, 4 GHz band and 6 GHz band, are branched and milliwaves such as, for example, 20 GHz band and 30 GHz band, are passed, the higher order mode milliwaves can be small and the length of the waveguide can be short.

BRIEF DESCRIPTION OF THE DRAWINGS

Various other objects, features, and attendant advantages of the present invention will be fully appreciated as the same becomes better understood from the following detailed description when considered in connection with the accompanying drawings, in which like reference characters designate like or corresponding parts throughout the several views, and wherein.

DETAILED DESCRIPTION OF THE PREFERRED EMBODIMENTS

The present invention relates to an improvement of a branching filter for branching two microwaves from waves having two microwaves and one or more milliwaves.

In order to simplify the description, the case of a wave having three frequency bands will be illustrated.

Figure 1:
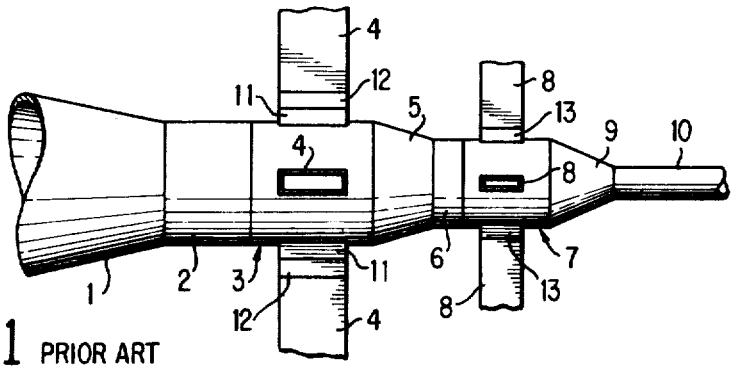
FIG. 1 PRIOR ART
FIG. 1 is a schematic view of a conventional branching filter.

The frequencies of the three bands are designated as $f_1$, $f_2$ and $f_3$ and have the relation of $f_1 < f_2 << f_3$, that is, $f_1$ and $f_2$ are microwaves, and $f_3$ is a milliwave, the branched waves being basic mode waves operatively associated with a conical horn and a circular waveguide conventionally utilized in communication systems. FIG. 1 is a schematic view of a conventional branching filter which branches waves having a frequency of $f_1$ or $f_2$ from a wave having frequencies $f_1$, $f_2$ and $f_3$ (hereinafter a wave having frequency $f$ is referred to as a wave $f$).

In FIG. 1, the reference numeral 1 designates a part of a conical horn of a primary radiator of an antenna, and 2 designates a circular waveguide. A branching filter 3 for wave $f_1$ is composed of four coupling holes, arranged to have equal angular displacements of 90° therebetween on the wall of the circular waveguide, and branching waveguides connected through a band-pass filter for reflecting waves $f_2$ and $f_3$ from each of the coupling holes. The reference numeral 4 designates a branching waveguide which is one element of the branching filter 3 for wave $f_1$, and 5 designates a circular tapered waveguide which reflects the wave $f_1$ but passes the waves $f_2$ and $f_3$. The reference numeral 6 designates a circular waveguide for connecting the branching filter 3 for the wave $f_1$ to the branching filter for the wave $f_2$. A branching filter 7 for the wave $f_2$ is similar to the branching filter 3 for wave $f_1$ and is composed of four coupling holes, band-pass filters for reflecting the wave $f_3$, and branching waveguides.

The reference numeral 8 designates a branching waveguide which is one element of branching filter 7 for the wave $f_2$. Numeral 9 designates a circular tapered waveguide which is designated to reflect the wave $f_2$ but pass the wave $f_3$, and 10 designates a circular waveguide for removing wave $f_3$. Numeral 11 designates a band-pass filter for reflecting the wave $f_2$ which is disposed within the branching filter 3 for the wave $f_1$. Numeral 12 designates a band-pass filter for reflecting the wave $f_3$ which is disposed within the branching filter 3 for the wave $f_1$, and 13 designates a band-pass filter for reflecting the wave $f_3$ which is disposed within the branching filter 7 for the wave $f_2$. The band pass filter 11 can be a resonant whisker while the band pass filters 12 and 13 can be Waffle Iron Filters.

In order to combine the waves from each of the branching waveguides, the branching waveguide 4 and the branching waveguide 8 are connected to a hybrid circuit for frequency bands $f_1$ and $f_2$ which is composed of waveguide circuit elements such as a Magic T, which is not shown in the drawing.

The case of receiving a wave, having frequencies $f_1$, $f_2$ and $f_3$, by an antenna will now be illustrated.

The wave $f_1$ is branched to four branching waveguides 4 disposed upstream of the tapered waveguide 5 at suitable positions under the utilization of cut-off characteristics of the tapered waveguide 5. In this case, the waves $f_2$ and $f_3$ are reflected by the band-pass filter 11 and the band-pass filter 12 each of which is disposed within the branching waveguide 4, and are passed through the branching filter 3 for the wave $f_1$ without leakage to the branching waveguide 4. The waves $f_2$ and $f_3$ passed through the branching filter 3 for the wave $f_1$ reach the branching filter 7 for the wave $f_2$. In the branching filter 7, the wave $f_2$ is branched to the branching waveguide 8 in a similar manner as that of the wave $f_1$ in the branch-filter 3 for the wave $f_1$ under utilization of the cut-off characteristics of the tapered waveguide 9.

In this case, the wave $f_3$ is passed through the branching filter 7 for the wave $f_2$, to the waveguide 10 without entering the branching waveguide 8 because of the band-pass filter 13 disposed within the branching waveguide 8. As stated above, the waves $f_1$, $f_2$ and $f_3$ are branched by the conventional branching filter.

In the conventional branching filter, the branching filter 3 for the wave $f_1$ and the branching filter 7 for the wave $f_2$ are connected through the tapered waveguide 5 and the circular waveguide 6, such that the axial length of the branching filter is longer than desired.

Moreover, many higher order mode waves are generated at the connection between the tapered waveguide 5 and the tapered waveguide 9, because the waveguides are oversized waveguides with respect to the milliwave $f_3$ such that the frequency band, being utilizable for the wave $f_3$, is disadvantageously narrow.

The invention, which overcomes these disadvantages, has the characteristics of providing four coupling holes for branching the wave $f_1$ and four branching waveguides connected to each of the coupling holes with an equal angle of circumference of 90° therebetween, and four coupling holes for branching the wave $f_2$ and four branching waveguides connected to each of the coupling holes, at a circumferential position of 45° offset with respect to the coupling holes for branching the wave $f_1$, whereby the branching filters for branching waves $f_1$ and $f_2$ can be equipped with a conical horn for the primary radiator of the antenna.

Figure 2A:
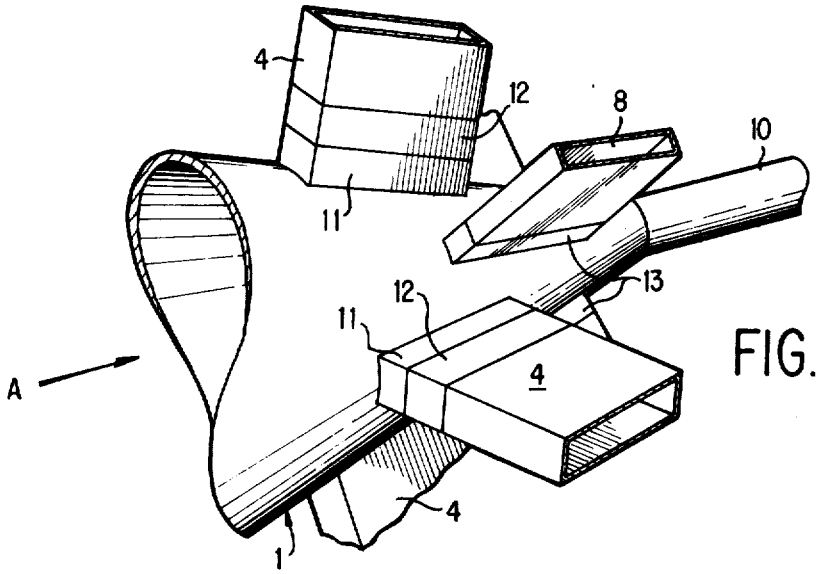
FIG. 2*a* is a partially broken schematic view of one embodiment of the branching filter constructed according to the present invention.
Figure 2B:
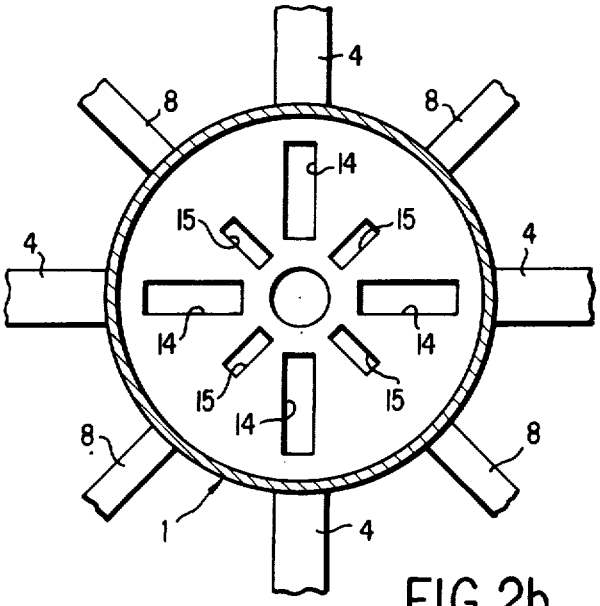
FIG. 2*b* is an end view of the branching filter of FIG. 2*a* observed in the direction of the arrow line A of FIG. 2*a*.

FIGS. 2*a* and 2*b* shows one embodiment of the branching filter constructed according to the invention.

In FIG. 2*a*, the reference numeral 1 designates a conical horn of the antenna type primary radiator, and 4 designates branching waveguides, for removing wave $f_1$, which are connected through the coupling holes and the band-pass filters for reflecting the waves $f_2$ and $f_3$ to the conical horn 1, and which are arranged with equal angles of circumference of 90° therebetween. Numeral 8 designates branching waveguides, for removing wave $f_2$, which are connected through the coupling holes and the band-pass filters for reflecting the wave $f_3$ to the conical horn 1, and which are arranged at positions offset by an angular displacement of 45° with respect to the branching waveguides 4. Numeral 10 designates a circular waveguide for removing wave $f_3$, and 11 and 12 designate respectively, filters for reflecting waves $f_2$ and $f_3$, which are disposed within the branching waveguides 4. Numeral 13 designates a band-pass filter for reflecting the wave $f_3$, which is disposed within the branching waveguide 8. The branching waveguide 4 and the branching wave 8 are connected to the hybrid circuit for the frequency bands $f_1$ and $f_2$, which are not shown in the drawings.

FIG. 2*b* shows the arrangement of the coupling holes formed on the wall of the conical horn of FIG. 2*a* in the view from the antenna side. In FIG. 2*b*, the reference numeral 14 designates a coupling hole for branching the wave $f_2$.

As is clear from a comparison of the structure of the branching filter of the present invention with that of the conventional branching filter, the wave having frequency bands $f_1$, $f_2$ and $f_3$ received by the antenna can be branched as that of the conventional complicated branching filter by arranging a group of the coupling holes 14 and a group of the coupling holes 15 at suitable positions with respect to the equivalent breaking surface of the conical horn 1.

In the branching filter of the present invention, the coupling holes 14 for branching the wave $f_1$, and the branching waveguides 4 connected to each of the coupling holes, are arranged at a position offset by an angle of 45° with respect to the coupling holes 15 for the branching the wave $f_2$ and the branching waveguides 8 connected to such coupling holes.

Accordingly, even though the frequency $f_1$ is near the frequency $f_2$, each group of coupling holes for branching the waves $f_1$ and $f_2$ and the branching waveguides thereof can be arranged on the conical horn without any difficulty, whereby a branching filter having a short axial length can be attained.

It is additionally noted that with respect to the axial spacing between the two sets of coupling holes, filters, and waveguides, such may be readily determined in accordance with the following, when taken in conjunction with FIG. 2*a*.

In the following sketch, which corresponds to a cross-section of the conical horn of FIG. 2*a*,

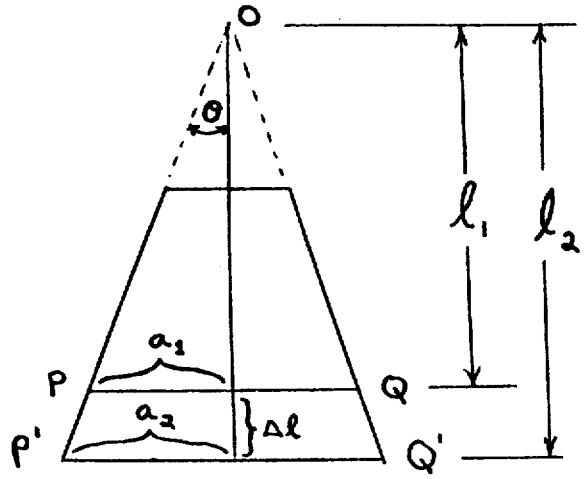

O: apex of conical horn 1
P,Q: centers of coupling holes 15
P', Q': centers of coupling holes 14

$\Delta l = l_2 - l_1$: relative axial spacing between the two sets of coupling holes The following relations are given for the parameters characteristics of the horn structure:

$$\tan\theta = a_n / l_n \quad (1)$$

$$2a_n = (1.84\ \lambda_n / \pi) \quad (2)$$

n = 1 or 2

$\lambda_n$: free space central frequency wavelength 1.84: constant decided by the fundamental wave.

In determining then, the relative axial spacing between the coupling holes, $\theta$ is determined depending upon the particular antenna employed. When, for example, frequencies 6GHz and 4GHz are used, the free space wavelengths $\lambda_n$ corresponding to such frequencies are inserted within equation (2) so as to give the values of $a_1$, and $a_2$, and such values of $a_1$, and $a_2$ can then be inserted in equation (1), whereby the values of $l_1$, and $l_2$ are determined. Accordingly, $\Delta l = l_2 - l_1$ is determined.

The following is an example wherein $\lambda_1$ and $\lambda_2$ are free space wavelengths at 6 GHz and 4 GHz, respectively. When $\theta$ is determined by the antenna configuration properties, $\Delta l$ is easily obtained, by using equations (1) and (2), as follows:

If: $\lambda_2$ = 74.95 mm;

$\lambda_1$ = 49.97 mm;

$a_1$ = 21.95mm;

$a_2$ = 14.64mm; and $\theta$ = 20°, then $\Delta l$ = 20.08mm.

Moreover, in the branching filter of the present invention, it is unnecessary to provide a linear circular waveguide between the conical horn 1 and the circular waveguide 10 such that a non-continuous port in the axial direction is not formed at the position that the oversized waveguide is formed with respect to the milliwave $f_3$. Therefore, the generation of a higher order mode having the frequency $f_3$ can be advantageously minimized.

As it is clear from the description, the number of the frequency bands for branching the wave is not limited to three frequency bands and can be more than three frequency bands. Moreover, as eight coupling holes are uniformly arranged about the filter device and with an angular displacement of 45° between the two groups, with filters 12 and 13 reflecting the milliwave $f_3$ at the noted positions, the generation of higher order mode waves is remarkably small.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A branching filter for a wave having multi-frequency bands, comprising:

two groups of coupling holes each of which is respectively connected to band-pass filter means and a branching waveguide, the filter means connected to one of said groups of holes being different from the filter means connected to another one of said groups of holes so as to selectively filter and branch waves having a particular frequency band into said respective branching waveguides, said one of said groups of said coupling holes being arranged on a wall of a conical horn with an equal angle of circumference of 90 degrees between adjacent holes of said one of said groups of said coupling holes, and said another one of said groups of said coupling holes being arranged on said wall of said conical horn with predetermined angles being defined between adjacent holes of said another one of said groups of said coupling holes, each of said holes of said another one of said groups of said coupling holes also being interposed between and separated from said adjacent holes of said one of said groups of said coupling holes by predetermined angles of circumference therebetween.

2. A branching filter according to claim 1, wherein said conical horn is a primary radiator of an antenna.

3. A branching filter as set forth in claim 1, wherein:

said coupling holes of said another one of said groups are separated from each other by an angle of 90° and are separated from the holes of said one group by an angle of 45°.

4. A branching filter as set forth in claim 1, wherein:

said coupling holes of said two groups are disposed within different planes perpendicular to the longitudinal axis of said conical horn with a predetermined axial spacing therebetween.

5. A branching filter for a wave having multi-frequency bands, comprising:

a first group of coupling holes having first branching filter means and a first branching waveguide connected thereto for branching a wave having a first frequency band, said first group of coupling holes being arranged on a wall of a conical horn with an equal angle of circumference of 90 degrees between each of said first coupling holes, and a second group of coupling holes having second branching filter means and a second branching waveguide connected thereto for branching a wave having a second frequency band, said second group of coupling holes being arranged on said wall and with respect to said first coupling holes so as to have an angle of circumference of 45 degrees between each of said second coupling holes and adjacent coupling holes of said first branching filter means.

6. A branching filter according to claim 5, wherein said conical horn is a primary radiator of an antenna.

* * * * *